US006109162A

United States Patent [19]

Tawada

[11] Patent Number: 6,109,162

[45] Date of Patent: Aug. 29, 2000

[54] CONTROL VALVE SYSTEM

[75] Inventor: Kozo Tawada, Gifu, Japan

[73] Assignee: Teijin Seiki Co., Ltd., Osaka, Japan

[21] Appl. No.: 09/342,134

[22] Filed: Jun. 29, 1999

[30] Foreign Application Priority Data

Dec. 2, 1998 [JP] Japan ..... 10-342444

[51] Int. Cl.[7] ..... F15B 13/044

[52] U.S. Cl. ..... 91/360; 91/363 A; 91/459; 91/466; 137/624.27; 137/625.65; 137/625.69

[58] Field of Search ..... 91/360, 363 A, 91/459, 466; 137/624.27, 625.65, 625.69

[56] References Cited

U.S. PATENT DOCUMENTS

| | | | |
|---|---|---|---|
| 3,618,984 | 11/1971 | Cook et al. | 137/624.27 X |
| 3,640,146 | 2/1972 | Barnes | 137/624.27 X |
| 4,041,983 | 8/1977 | Bianchetta | 137/624.27 X |
| 4,046,165 | 9/1977 | Rose et al. | 137/624.27 |
| 4,090,429 | 5/1978 | Kamimura | 91/363 A X |
| 4,190,081 | 2/1980 | Coles | 137/624.27 |
| 4,936,196 | 6/1990 | Kamimura et al. | 91/360 |

*Primary Examiner*—Gerald A. Michalsky
*Attorney, Agent, or Firm*—Venable; Richard L. Aitken

[57] ABSTRACT

A fluid control valve system for controlling the flow of hydraulic fluid supplied to and discharged out of an actuator having first and second actuator ports, comprising: a valve housing having a pressure sensing chamber for sensing the pressure of the hydraulic fluid introduced therein and a pressure port for introducing a hydraulic fluid; a valve spool axially movably received in the valve housing; valve spool operating means having the valve spool axially moved and including a force motor, a piston rod having the valve spool slidably received thereon and driven by the force motor, and a fixed piston firmly connected with the piston rod; and resiliently urging means for resiliently urging the valve spool along the center axis of the valve housing, the valve spool being urged by the hydraulic pressure of the hydraulic fluid in the pressure sensing chamber and the resiliently urging means to assume operation positions consisting of normal operation positions where the hydraulic pressure of the hydraulic fluid in the pressure sensing chamber is larger than the resilient force of the resiliently urging means to have the valve spool axially moved together with the piston rod of the valve spool operating means and an abnormal operation position where the hydraulic pressure in the pressure sensing chamber is reduced until the resiliently urging means starts to urge and axially move the valve spool toward the fixed piston to have the valve spool brought into contact with the fixed piston with the pressure port being held out of communication with the first and second actuator ports of the actuator.

10 Claims, 9 Drawing Sheets

CONTROL VALVE SYSTEM

FIELD OF THE INVENTION

The present invention relates to a fluid control apparatus, and more particularly to a fluid control valve system for controlling the flow of hydraulic fluid supplied to and discharged from a hydraulic fluid actuator.

BACKGROUND OF THE INVENTION

Conventionally, there have been proposed a fluid control apparatus of this type which is shown in FIG. 9 as comprising a hydraulic fluid actuator 10, a piston rod 10*a*, and a piston 10*b* securely connected with the piston rod 10*a* and axially movably received in the hydraulic fluid actuator 10 to define first and second chambers 11 and 12. The piston rod 10*a* is axially movable between two axial positions consisting of an extension position where the hydraulic fluid is supplied to the first chamber 11 and discharged from the second chamber 12, and a retraction position where the hydraulic fluid is supplied to the second chamber 12 and discharged from the first chamber 11.

The fluid control apparatus further comprises a housing 13, a servo valve 14 securely mounted on the housing 13 and having supply and return ports 14*a* and 14*b* and first and second pressure control ports 14*c* and 14*d*, a swivel joint member 15 rotatably received in the housing 13 and having supply and return ports 15*a* and 15*b* to have the hydraulic fluid supplied to the supply port 14*a* of the servo valve 14 and discharged from the return port 14*b* of the servo valve 14, respectively, a filter 16 provided in the fluid passageways between the swivel joint member 15 and the servo valve 14 to filtrate the hydraulic fluid passing therethrough. The servo valve 14 is operated by two external signals to selectively bring about first and second flow conditions of the hydraulic fluid to the hydraulic fluid actuator 10. The first flow condition is accomplished by having the first pressure control port 14*c* brought into fluid communication with one of the first and second chambers 11 and 12 of the hydraulic fluid actuator 10. The second flow condition, on the other hand, is accomplished by having the second pressure control port 14*d* brought into fluid communication with the other of the first and second chambers 11 and 12 of the hydraulic fluid actuator 10.

The fluid control apparatus further comprises a check valve 17 provided in the fluid passageway between the second pressure control port 14*d* and the second chamber 12 of the hydraulic fluid actuator 10 to serve as being opened by the pressure in the hydraulic fluid from the supply port 15*a* of the swivel joint member 15 and being closed by the spring, not shown in the drawings, of the check valve 17. The check valve 17 is operated to be closed to prevent the piston rod 10*a* of the hydraulic fluid actuator 10 from being extended when the fluid control apparatus falls into an abnormal condition having the pressure of the hydraulic fluid drastically decline resulting from some reasons. The opening operation of the check valve 17 can be performed by manually operating a manual relief valve 18 operatively connected to the check valve 17.

In order to allow the check valve 17 to be closed to prevent the piston rod 10*a* of the hydraulic fluid actuator 10 from being extended over a predetermined limit when the fluid control apparatus falls into such an abnormal condition, the fluid control apparatus is required to be of a coaxial type valve which comprises a spool valve, and a sleeve having the spool valve coaxially movably received therein and formed with ports through which the hydraulic fluid passes to the spool valve. This means that the conventional fluid control apparatus herein described encounters some problems that it is not only complex in construction but also increased in weight, size and costly. Moreover, the conventional fluid control apparatus tends to deteriorate in reliability.

It is therefore an object of the present invention to provide a fluid control apparatus which is simple in construction and has a high reliability.

It is another object of the present invention to provide a fluid control apparatus which is light, small in size and relatively inexpensive.

SUMMARY OF THE INVENTION

According to the first aspect of the present invention, there is provided a fluid control valve system for controlling the flow of hydraulic fluid supplied to and discharged out of an actuator having first and second actuator ports, comprising: a valve housing formed with a hole having a center axis to have an inner wall portion with a peripheral surface, the valve housing having first and second pressure ports having hydraulic fluid supplied therethrough, first and second return ports having the hydraulic fluid discharged therethrough, and first and second work ports respectively being held in communication with the first and second actuator ports of the actuator and having hydraulic fluid supplied and discharged therethrough; a valve spool axially movably received in the hole of the valve housing and formed with an axial through bore axially extending and open at its axial ends, the valve spool having an outer wall portion formed with first to third land portions axially spaced apart from each other to form a first groove between the first and second land portions and a second groove between the second and third land portions, the first and second grooves being axially spaced apart from each other and open at their outer surfaces thereof to define in combination with the peripheral surface of the inner wall portion of the valve housing first and second groove chambers respectively held in fluid communication with the first and second work ports of the valve housing and being able to be brought selectively into fluid communication with the first pressure port and the first return port, and the first pressure port and the second return port, of the valve housing; valve spool operating means including a force motor, a piston rod driven to be axially reciprocated by the force motor and having an axially intermediate portion axially extending in the hole of the valve housing, a stop flange firmly connected to the axially intermediate portion and facing the force motor, and a fixed piston firmly connected to the axial end of the axially intermediate portion remotest from the force motor, the piston rod having the valve spool slidably received on the axially intermediate portion between the stop flange and the fixed piston to form a pressure sensing chamber between the valve spool and the fixed piston in the hole of the valve housing, the pressure sensing chamber being held in communication with the second pressure port of the valve housing; and resiliently urging means for resiliently urging the valve spool toward the fixed piston of the valve spool operating means along the center axis of the valve housing. The valve spool is urged by the hydraulic pressure of the hydraulic fluid in the pressure sensing chamber and the resiliently urging means to assume operation positions consisting of: normal operation positions where the hydraulic fluid is supplied to the pressure sensing chamber to give the hydraulic pressure to the hydraulic fluid of the pressure sensing chamber, the hydraulic pressure in the pressure sensing chamber having the valve spool urged toward the stop flange against the resiliently urging means to have the valve spool brought into contact with the stop flange, the valve spool being reciprocated by the force motor with the piston rod to have the first pressure port and the first return port, and the first pressure port and the second return port selectively held in communication with the first and second actuator ports of the actuator respectively through the first and second work ports of the valve housing; and an abnormal operation position where the hydraulic pressure in the pressure sensing chamber is reduced until the resiliently urging means starts to urge and axially move the valve spool toward the fixed piston, the second pressure port being held out of communication with the first and second actuator ports of the actuator.

The piston rod of the fluid control valve system may be forced to move by the force motor with the valve spool assuming the normal operation position along the center axis of the hole of the valve housing with respect to the valve housing to assume three different operation positions consisting of: a first normal operation position where the first pressure port is closed by the second land portion of the valve spool, the second pressure port is open to the pressure sensing chamber, the first and second return ports are respectively closed by the first and third land portions of the valve spool, the first and second groove chambers are held in fluid communication with the first and second work ports of the valve housing when the force motor is not driven in any axial directions of the piston rod; a second normal operation position where the first and second pressure ports are respectively opened to the first groove chamber and the pressure sensing chamber with the first groove chamber being brought into fluid communication with the first work port to supply the hydraulic fluid to the first actuator port of the actuator, the first return port is closed by the first land portion of the valve spool with the second return port being opened to the second groove chamber of the valve spool to have the hydraulic fluid from the second actuator port of the actuator returned when the force motor is driven in one of the axial directions of the piston rod; and a third normal operation position where the first and second pressure ports are respectively opened to the second groove chamber and the pressure sensing chamber with the second groove chamber being brought into fluid communication with the second work port to supply the hydraulic fluid to the second actuator port of the actuator, the second return port is closed by the third land portion of the valve spool with the first return port being opened to the first groove chamber of the valve spool to have the hydraulic fluid from the first actuator port of the actuator returned when the force motor is driven in the other of the axial directions of the piston rod.

The resiliently urging means of the fluid control valve system may further comprise a supporting flange securely mounted on the axially intermediate portion of the piston rod between the force motor and the stop flange, and a compression coil spring securely connected to the supporting flange between the supporting flange and the valve spool to resiliently urge the valve spool toward the fixed piston.

The compression coil spring of the fluid control valve system may be in coaxial relationship with the hole of the valve housing.

The valve spool operating means of the fluid control valve system may further comprise a sleeve piston slidably received on the axially intermediate portion of the piston rod between the valve spool and the fixed piston to have the pressure sensing chamber formed between the valve spool and the sleeve piston in the hole of the valve housing so that the valve spool can be brought into contact with the fixed piston of the valve spool operating means by way of the sleeve piston.

According to the second aspect of the present invention, there is provided a fluid control valve system for controlling the flow of hydraulic fluid supplied to and discharged out of an actuator having first and second actuator ports, comprising: a valve housing formed with a hole having a center axis to have an inner wall portion with a peripheral surface, the valve housing having first and second pressure ports having hydraulic fluid supplied therethrough, first and second return ports having the hydraulic fluid discharged therethrough, and first and second work ports respectively being held in communication with the first and second actuator ports of the actuator and having hydraulic fluid supplied and discharged therethrough, a pressure fluid passageway having the first and second pressure ports held in communication with each other, and a return fluid passageway having the first and second return ports held in communication with each other; a valve spool axially movably received in the hole of the valve housing and formed with an axial through bore axially extending and open at its axial ends, the valve spool having an outer wall portion formed with first to fourth land portions axially spaced apart from each other to form a first groove between the first and second land portions, a second groove between the second and third land portions and a third groove between the third and fourth land portions, the first, second and third grooves being axially spaced apart from each other and open at their outer surfaces thereof to define in combination with the peripheral surface of the inner wall portion of the valve housing first to third groove chambers, the first groove chamber being held in fluid communication with the first work port and able to be brought selectively into fluid communication with the first return port of the valve housing, the second groove chamber being held in fluid communication with the first work port and able to be brought selectively into fluid communication with the first pressure port of the valve housing, while the third groove chamber being held in fluid communication with the second work port and able to be brought selectively into fluid communication with the first pressure port and the second return port of the valve housing; valve spool operating means including a force motor, a piston rod driven to be axially reciprocated by the force motor and having an axially intermediate portion axially extending in the hole of the valve housing, a stop flange firmly connected to the axially intermediate portion and facing the force motor, and a fixed piston firmly connected to the axial end of the axially intermediate portion remotest from the force motor, the piston rod having the valve spool slidably received on the axially intermediate portion between the fixed piston and the stop flange to form a pressure sensing chamber between the valve spool and the fixed piston in the hole of the valve housing, the pressure sensing chamber being held in communication with the second pressure port of the valve housing; and resiliently urging means for resiliently urging the valve spool toward the fixed piston of the valve spool operating means along the center axis of the valve housing. The valve spool is urged by the hydraulic pressure of the hydraulic fluid in the pressure sensing chamber and the resiliently urging means to assume operation positions consisting of: normal operation positions where the hydraulic fluid is supplied to the pressure sensing chamber to give the hydraulic pressure to the hydraulic fluid in the pressure sensing chamber, the hydraulic pressure in the pressure sensing chamber having the valve spool urged toward the stop flange against the resiliently urging means to have the valve spool brought into contact with the stop flange, the valve spool being reciprocated by the force motor with the piston rod to have the first pressure port and the first return port, and the first pressure port and the second return port selectively held in communication with the first and second actuator ports of the actuator respectively through the first and second work ports of the valve housing; and an abnormal operation position where the hydraulic pressure in the pressure sensing chamber is reduced until the resiliently urging means starts to urge and axially move the valve spool toward the fixed piston, the first pressure port being held out of communication with the first and second actuator ports of the actuator.

The piston rod of the fluid control valve system may be forced to move by the force motor with the valve spool assuming the normal operation position along the center axis of the hole of the valve housing with respect to the valve housing to assume three different operation positions consisting of: a first normal operation position where the first pressure port is closed by the third land portion of the valve spool, the second pressure port is open to the pressure sensing chamber, the first and second return ports are respectively closed by the first and fourth land portions of the valve spool, and the first and second groove chambers and the third groove chamber are respectively held in fluid communication with the first and second work ports of the valve housing when the force motor is not driven in any axial directions of the piston rod; a second normal operation position where the first and second pressure ports are respectively opened to the second groove chamber and the pressure sensing chamber with the second groove chamber being brought into fluid communication with the first work port to supply the hydraulic fluid to the first actuator port of the actuator, the first return port is closed by the first land portion of the valve spool with the second return port being opened to the third groove chamber of the valve spool to have the hydraulic fluid from the second actuator port of the actuator returned when the force motor is driven in one of the axial directions of the piston rod; and a third normal operation position where the first and second pressure ports are respectively opened to the third groove chamber and the pressure sensing chamber with the third groove chamber being brought into fluid communication with the second work port to supply the hydraulic fluid to the second actuator port of the actuator, the second return port is closed by the fourth land portion of the valve spool with the first return port being opened to the first groove chamber of the valve spool to have the hydraulic fluid from the first actuator port of the actuator returned when the force motor is driven in the other of the axial directions of the piston rod.

The resiliently urging means of the fluid control valve system may further comprise a supporting flange securely mounted on the axially intermediate portion of the piston rod between the force motor and the stop flange, and a compression coil spring securely connected to the supporting flange between the supporting flange and the valve spool to resiliently urge the valve spool toward the fixed piston.

The compression coil spring of the fluid control valve system may be in coaxial relationship with the hole of the valve housing.

The valve spool operating means of the fluid control valve system may be further comprise a sleeve piston slidably received on the axially intermediate portion of the piston rod between the valve spool and the fixed piston to have the pressure sensing chamber formed between the valve spool and the sleeve piston in the hole of the valve housing so that the valve spool can be brought into contact with the fixed piston of the valve spool operating means by way of the sleeve piston.

BRIEF DESCRIPTION OF THE DRAWINGS

The features and advantages of a fluid control valve system according to the present invention will be more clearly understood from the following description taken in conjunction with the accompanying drawings in which.

DESCRIPTION OF THE PREFERRED EMBODIMENTS

A preferred embodiment of the fluid control valve system according to the present invention will now be described in detail in accordance with the accompanying drawings.

Figure 1:
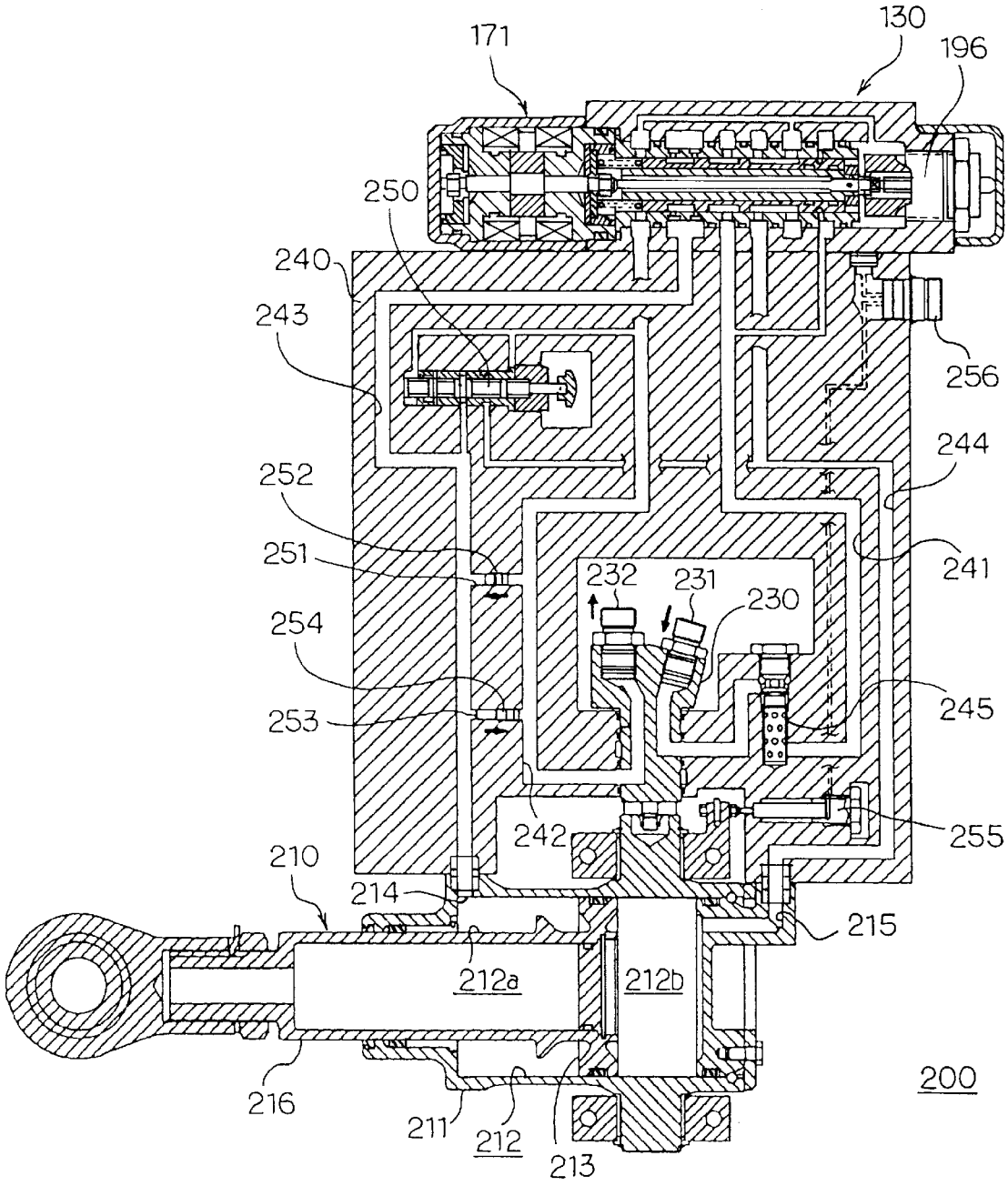
FIG. 1 is a cross-sectional view of a preferred embodiment of a fluid control apparatus comprising a fluid control valve system according to the present invention for controlling an actuator.

The fluid control valve system according to the present invention is shown in FIG. 1 to have reference numeral 130 and assembled in a fluid control apparatus 200. The fluid control apparatus 200 herein disclosed comprises an actuator 210 having first and second actuator ports 214 and 215, a swivel joint 230 having a supply port 231 and a return port 232, and a housing 240 having the actuator 210 and the fluid control valve system 130 securely connected thereto and supported thereon. The fluid control valve system 130 is adapted to control the flow of the hydraulic fluid supplied to and discharged out of the actuator 210.

Before the structure and the operation of the fluid control apparatus 200 is described in detail, the principle structure and the operation of the fluid control valve system according to the present invention will be explained with reference to FIGS. 2 to 5 each showing a fragmentary cross-sectional view of a control valve system 30. The control valve system 30 is the same in operational functions as the control valve system 130 shown in FIG. 1, and will therefore be described with its principle structure and operation according to the present invention as will be seen from FIGS. 2 to 5.

Figure 2:
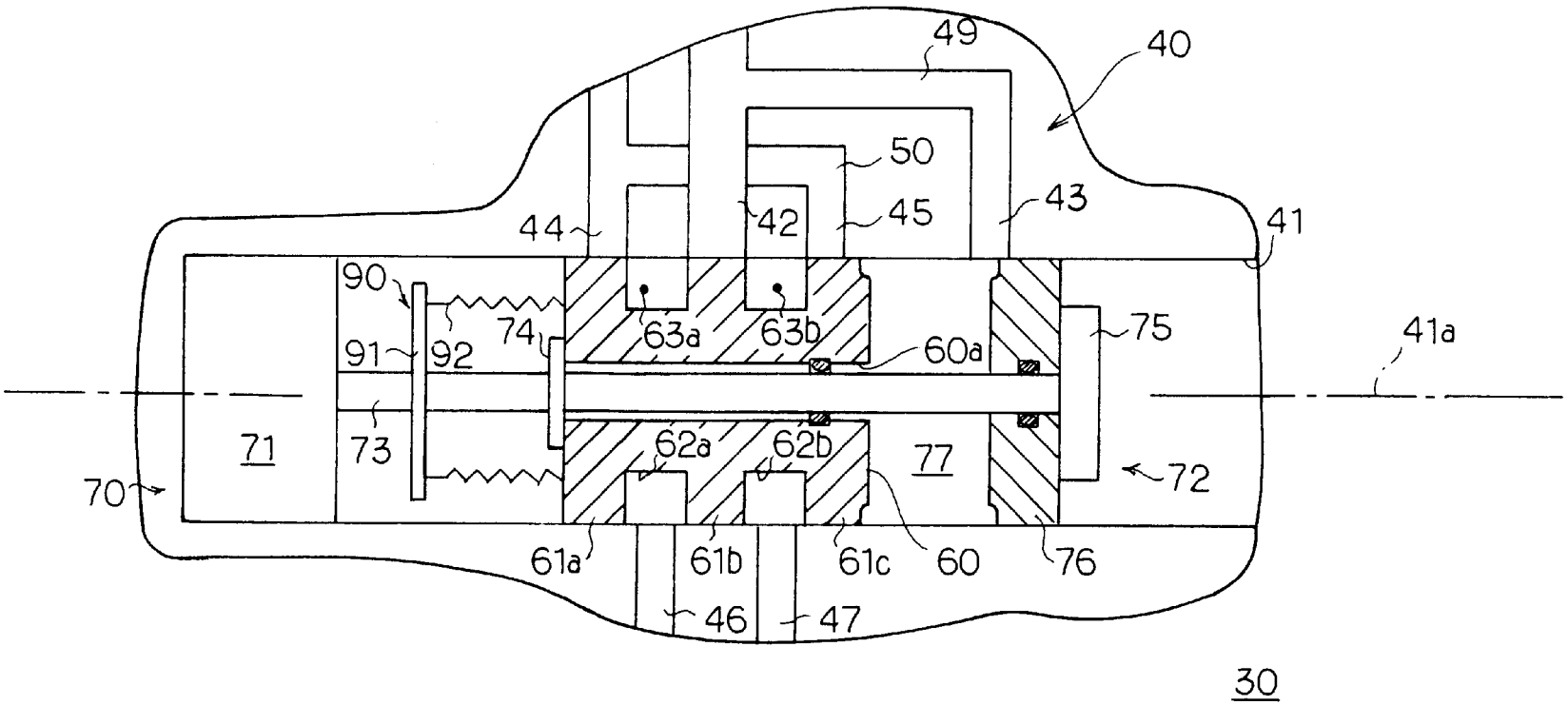
FIG. 2 is a fragmentary cross-sectional view of the fluid control valve system according to the present invention when the spool valve is axially moved to assume its first normal operation position but roughly shows its structure for better understanding of the principle of the fluid control valve system according to the present invention.

The fluid control valve system 30 is shown in FIG. 2 to comprise a valve housing 40, a valve spool 60, valve spool operating means 70 and resiliently urging means 90.

The valve housing 40 is formed with a hole 41 having a center axis 41a and has an inner wall portion with a peripheral surface. The valve housing 40 comprises first and second pressure ports 42 and 43 held in communication with the supply port 231 of the swivel joint 230 shown in FIG. 1 and having hydraulic fluid supplied therethrough, and first and second return ports 44 and 45 held in communication with the return port 232 of the swivel joint 230 also shown in FIG. 1 and having the hydraulic fluid discharged therethrough. The valve housing 40 further comprises first and second work ports 46 and 47 respectively held in communication with the first and second actuator ports 214 and 215 of the actuator 210 also shown in FIG. 1 and having hydraulic fluid supplied and discharged therethrough. The valve housing 40 further comprises a pressure fluid passageway 49 having the first and second pressure ports 42 and 43 held in communication with each other, and a return fluid passageway 50 having the first and second return ports 44 and 45 held in communication with each other.

The valve spool 60 is axially movably received in the hole 41 of the valve housing 40 and formed with an axial through bore 60*a* axially extending and open at its both axial ends. The valve spool 60 has an outer wall portion formed with first to third land portions 61*a* to 61*c* axially spaced apart from each other to form a first groove 62*a* between the first and second land portions 61*a* and 61*b* and a second groove 62*b* between the second and third land portions 61*b* and 61*c*. The first and second grooves 62*a* and 62*b* are axially spaced apart from each other and open at their outer surfaces thereof to define in combination with the peripheral surface of the inner wall portion of the valve housing 40 first and second groove chambers 63*a* and 63*b* respectively held in fluid communication with the first and second work ports 46 and 47 of the valve housing 40. The first groove chamber 63*a* is adapted to be brought selectively into fluid communication with the first pressure port 42 and the first return port 44 of the valve housing 40, while the second groove chamber 63*b* is adapted to be brought selectively into fluid communication with the first pressure port 42 and the second return port 45 of the valve housing 40 when the valve spool 60 is axially moved in any one of the axial directions from the state shown in FIG. 2.

The valve spool operating means 70 comprises a force motor 71, a piston rod 72 driven to be axially reciprocated by the force motor 71 and having an axially intermediate portion 73 axially extending in the hole 41 of the valve housing 40, a stop flange 74 firmly connected to the axially intermediate portion 73 and facing the force motor 71, and a fixed piston 75 firmly connected to the axial end of the axially intermediate portion 73 remotest from the force motor 71. The piston rod 72 have the valve spool 60 slidably received on the axially intermediate portion 73 between the stop flange 74 and the fixed piston 75 to form a pressure sensing chamber 77 between the valve spool 60 and the fixed piston 75 in the hole 41 of the valve housing 40. The pressure sensing chamber 77 is held in communication with the second pressure port 43 of the valve housing 40. The valve spool operating means 70 further comprises a sleeve piston 76 slidably received on the axially intermediate portion 73 between valve spool 60 and the fixed piston 75 in the hole 41 of the valve housing 40. In this case, the pressure sensing chamber 77 is formed between the valve spool 60 and the sleeve piston 76 in the hole 41 of the valve housing 40.

The resiliently urging means 90 is adapted to resiliently urge the valve spool 60 toward the fixed piston 75 of the valve spool operating means 70 along the center axis 41*a* of the hole 41 of the valve housing 40. The resiliently urging means 90 comprises a supporting flange 91 securely mounted on the axially intermediate portion 73 of the piston rod 72 between the force motor 71 and the stop flange 74, and a compression coil spring 92 securely connected to the supporting flange 91 between the supporting flange 91 and the valve spool 60 to resiliently urge the valve spool 60 toward the fixed piston 75. The compression coil spring 92 may be of the type having an center axis in coaxial relationship with the hole 41 of the valve housing 40.

The operation of the control valve system 30 previously mentioned will be described hereinafter with reference to FIGS. 2 to 5.

The valve spool 60 is urged by the hydraulic pressure of the hydraulic fluid in the pressure sensing chamber 77 and the resiliently urging means 90 to assume different operation positions consisting of first to third normal operation positions and an abnormal operation position.

When the hydraulic fluid is supplied to the second pressure port 43 from the supply port 231 of the swivel joint 230 shown in FIG. 1, the hydraulic fluid is introduced into the pressure sensing chamber 77 to give the hydraulic pressure to the hydraulic fluid in the pressure sensing chamber 77. At this time, the pressure of the hydraulic fluid in the pressure sensing chamber 77 becomes larger than the axial force of the resiliently urging means 90 to have the valve spool 60 urged toward the stop flange 74 to have its one axial end brought into contact with the stop flange 74. At the same time, the sleeve piston 76 is urged toward the fixed piston 75 of the valve spool operating means 70 to have its one axial end brought into contact with the fixed piston 75. The valve spool 60, therefore, assumes the first normal operation position as shown in FIG. 2.

Under these conditions, the first pressure port 42 is closed by the second land portion 61*b* of the valve spool 60, the first and second return ports 44 and 45 are respectively closed by the first and third land portions 61*a* and 61*c* of the valve spool 60, and the first and second groove chambers 63*a* and 63*b* are respectively held in fluid communication with the first and second work ports 46 and 47 of the valve housing 40. The hydraulic fluid is thus not introduced into nor discharged out of the actuator 210 shown in FIG. 1.

Figure 3:
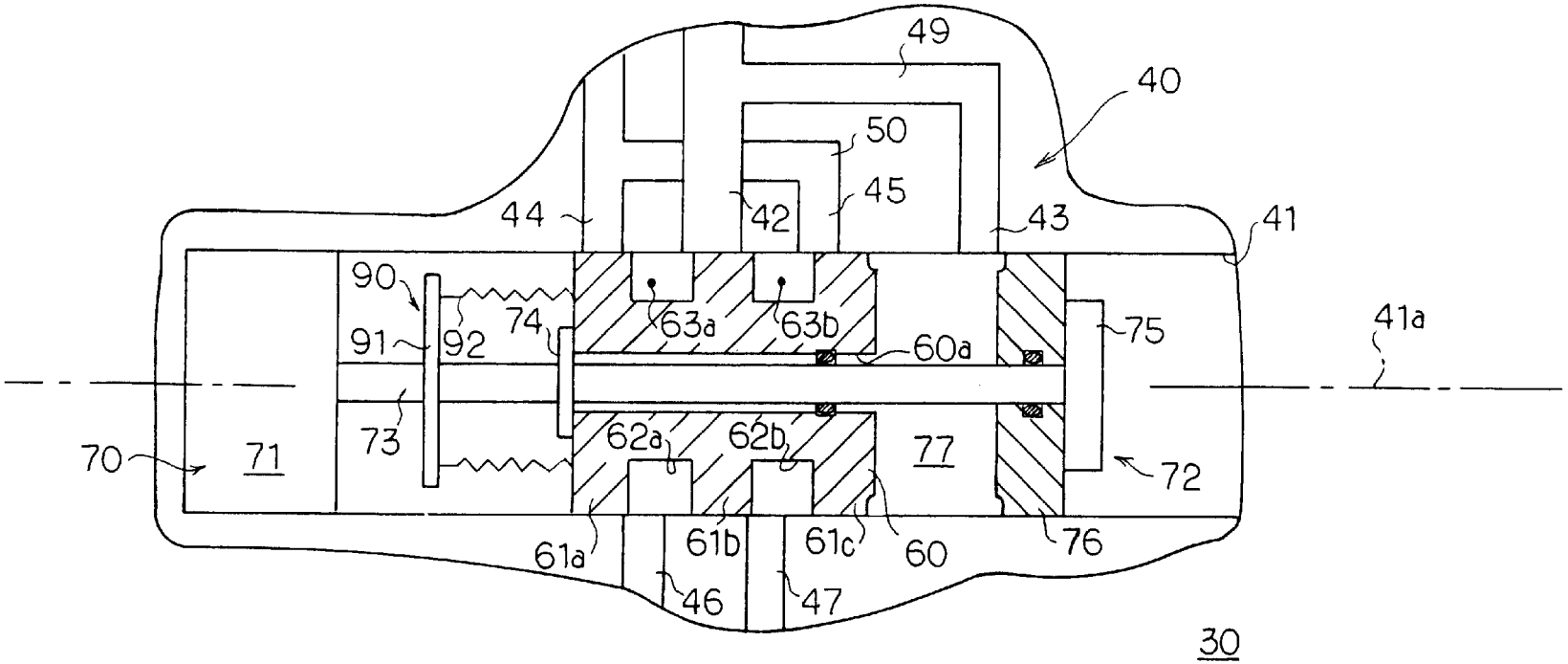
FIG. 3 is a view similar to FIG. 2 but showing that the spool valve is forced to move in cooperation with the piston rod to assume its second normal operation position.
Figure 4:
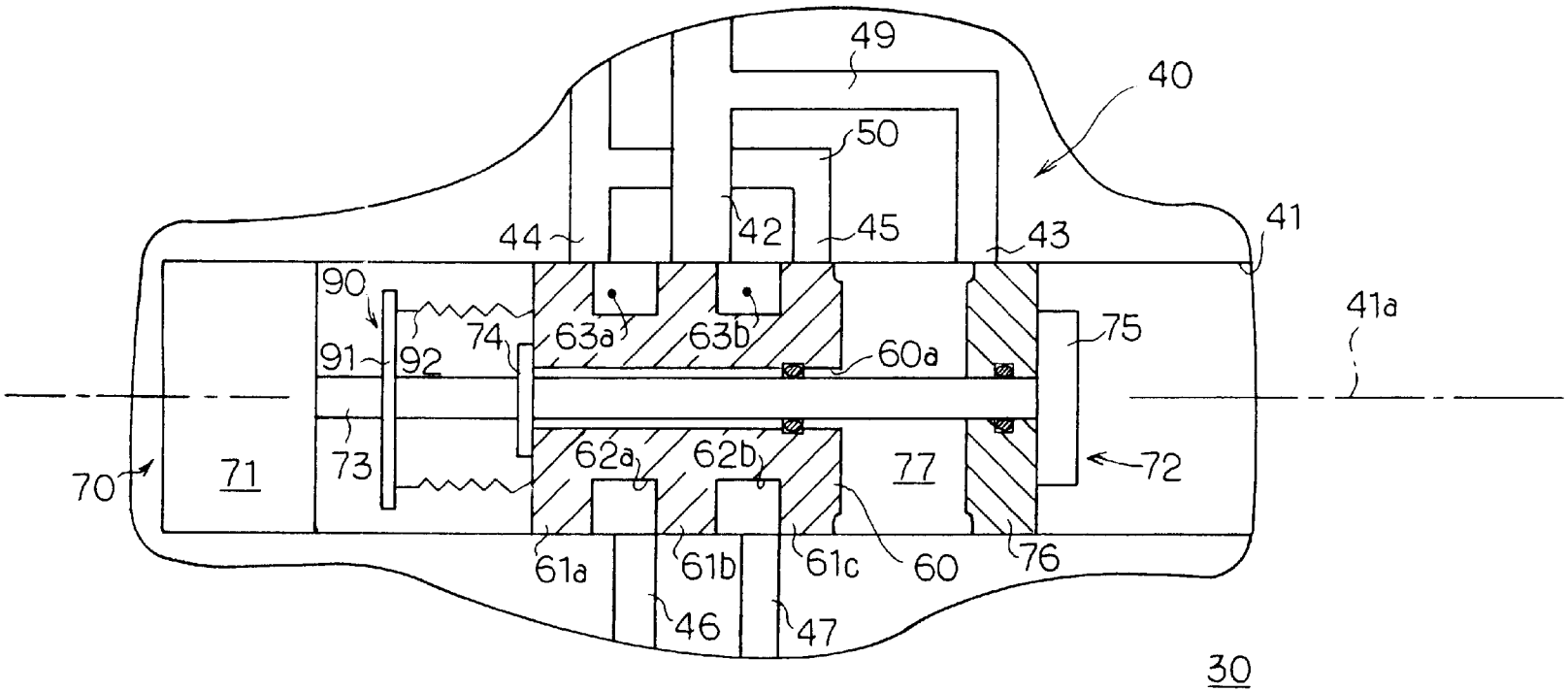
FIG. 4 is a view similar to FIG. 2 but showing that the spool valve is forced to move in cooperation with the piston rod to assume its third normal operation position.

The valve spool 60 is then reciprocated from the first normal operation positions shown in FIG. 2 by the force motor 71 with the one axial end of the valve spool 60 held in contact with the stop flange 74 of the valve spool operating means 70, in cooperation with the piston rod 72 to assume second and third normal operation positions, respectively shown in FIGS. 3 and 4.

When the force motor 71 is driven to have the piston rod 72 moved from the state as shown in FIG. 2 in one of the axial directions of the valve spool 60, rightward in FIG. 2 for example, the valve spool 60 assumes the second normal operation position as shown in FIG. 3.

At this time, the first and second pressure ports 42 and 43 are respectively opened to the first groove chamber 63*a* and the pressure sensing chamber 77 with the first groove chamber 63*a* held in fluid communication with the first work port 46 of the valve housing 40. Therefore, the hydraulic fluid is introduced into the first groove chamber 63*a* as well as into the pressure sensing chamber 77. The hydraulic fluid introduced into the first groove chamber 63*a* is then supplied to the first actuator port 214 of the actuator 210 shown in FIG. 1. At the same time, the first return port 44 is closed by the first land portion 61*a* of the valve spool 60 and the second return port 45 is opened to the second groove chamber 63*b* with the second groove chamber 63*b* held in fluid communication with the second work port 47 of the valve housing 40. Therefore, the hydraulic fluid discharged out of the second actuator port 215 of the actuator 210 is introduced into the second groove chamber 63*b*. The hydraulic fluid introduced into the second groove chamber 63*b* is then discharged out of the return port 232 of the swivel joint 230 through the second return port 45.

When, on the other hand, the force motor 71 is driven to have the piston rod 72 moved from the state as shown in FIG. 2 in the other of the axial directions of the valve spool 60, leftward in FIG. 2 for example, the valve spool 60 assumes the third normal operation position as shown in FIG. 4.

At this time, the first and second pressure ports 42 and 43 are respectively opened to the second groove chamber 63*b* and the pressure sensing chamber 77 with the second groove chamber 63*b* held in fluid communication with the second work port 47 of the valve housing 40. Therefore, the hydraulic fluid is introduced into the second groove chamber 63*b* as well as into the pressure sensing chamber 77. The hydraulic fluid introduced into the second groove chamber 63*b* is then supplied to the second actuator port 215 of the actuator 210 shown in FIG. 1. At the same time, the first return port 44 is opened to the first groove chamber 63*a* and the second return port 45 is closed by the third land portion 61*c* of the valve spool 60 with the first groove chamber 63*a* held in fluid communication with the first work port 46 of the valve housing 40. Therefore, the hydraulic fluid discharged out of the first actuator port 214 of the actuator 210 is introduced into the first groove chamber 63*a*. The hydraulic fluid introduced into the first groove chamber 63*a* is then discharged out of the return port 232 of the swivel joint 230 through the first return port 44.

Figure 5:
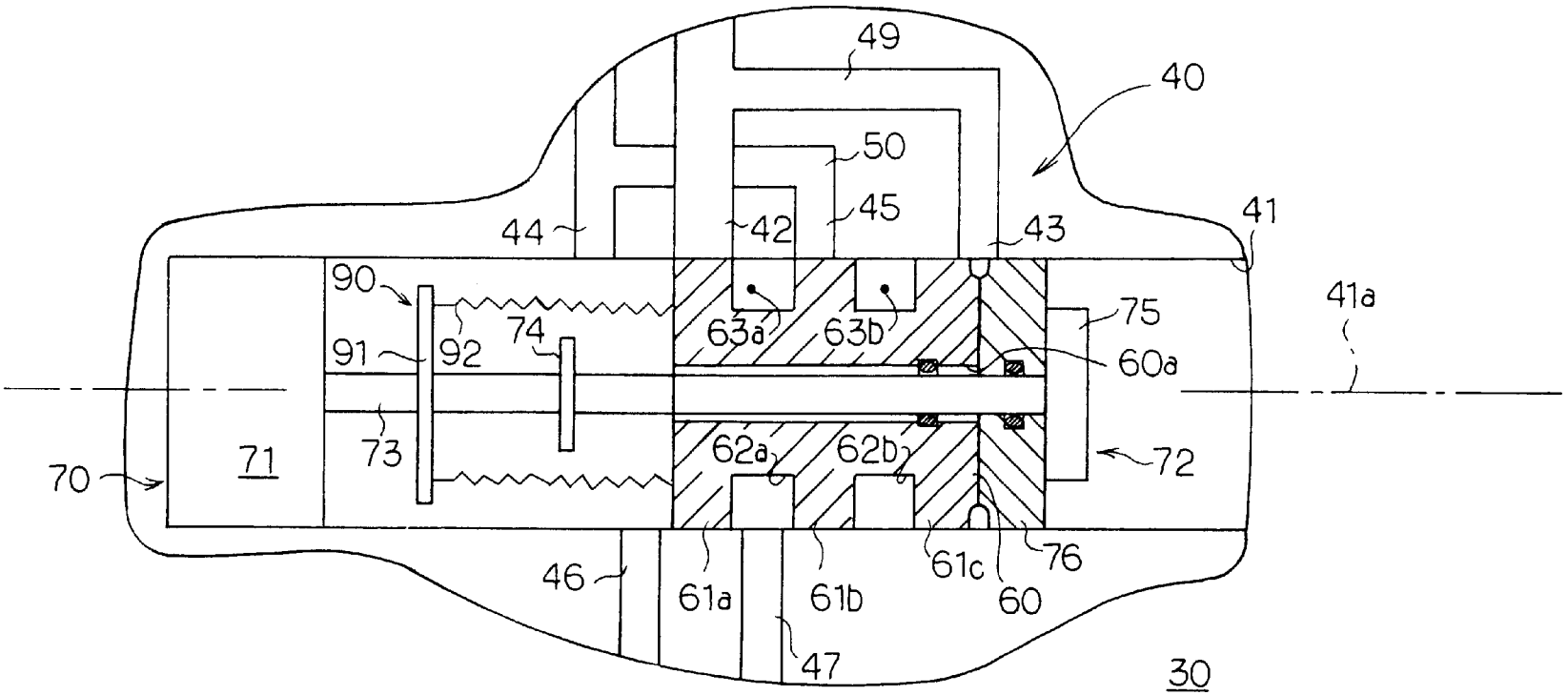
FIG. 5 is a view similar to FIG. 2 but showing that the spool valve is forced to move to assume its abnormal operation position.

In the event that the hydraulic fluid is not supplied to the pressure sensing chamber 77 for some reason, the pressure of the hydraulic fluid in the pressure sensing chamber 77 is reduced and becomes lower than the axial force of the resilient urging means 90. Then, the resiliently urging means 90 urges and axially move the valve spool 60 toward the fixed piston 75 to have the valve spool 60 brought into contact with the sleeve piston 76 of the valve spool operating means 70 to assume an abnormal operation position as shown in FIG. 5. At this time, the first and second pressure ports 42 and 43 are respectively closed by the first land portion 61*a* and the third land portion 61*c*. The hydraulic fluid is thus not introduced into the actuator 210.

Figure 6:
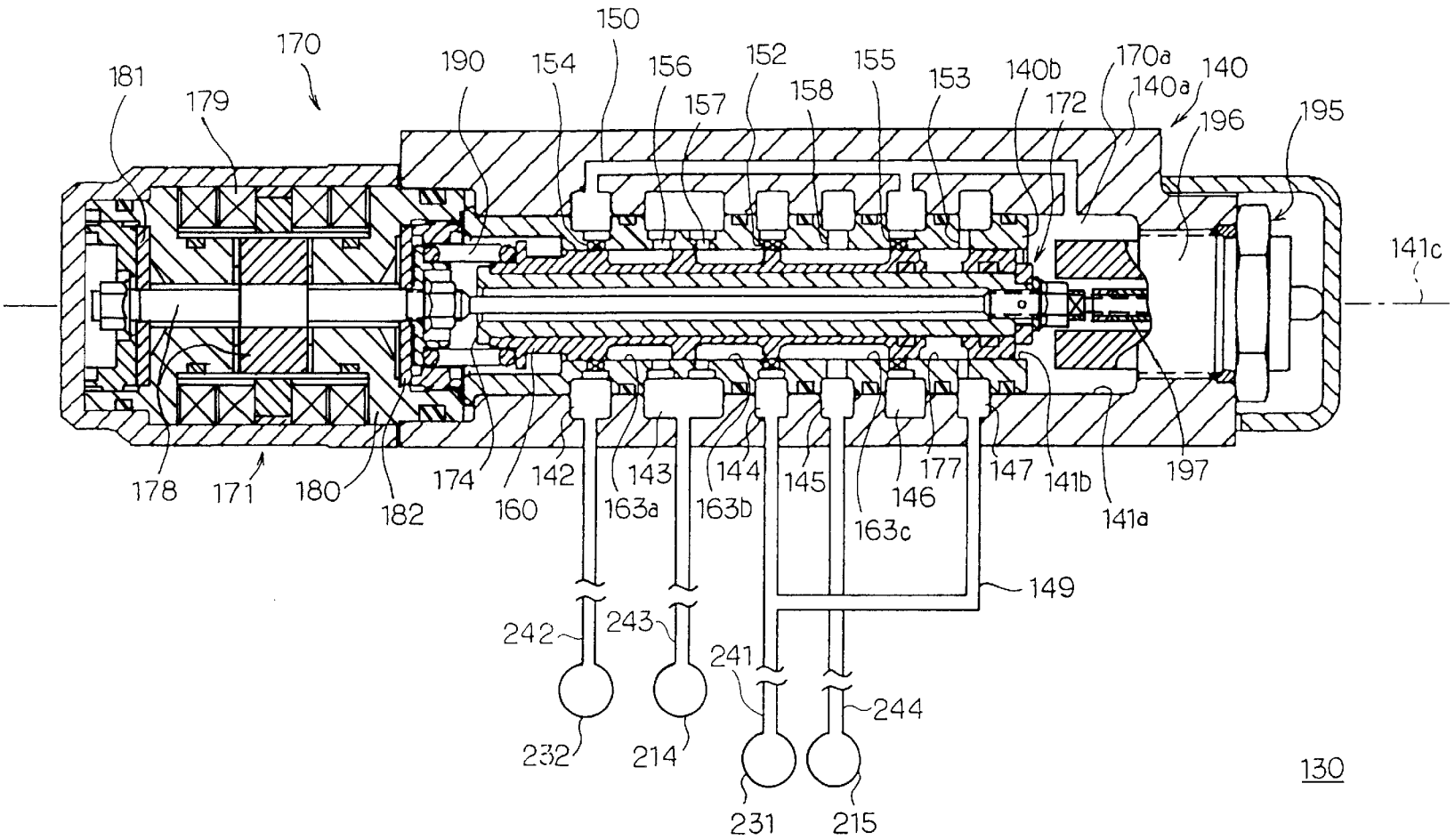
FIG. 6 is a cross-sectional view of a preferred embodiment of the fluid control valve system according to the present invention, and showing that the spool valve is axially moved to assume its first normal operation position.
Figure 7:
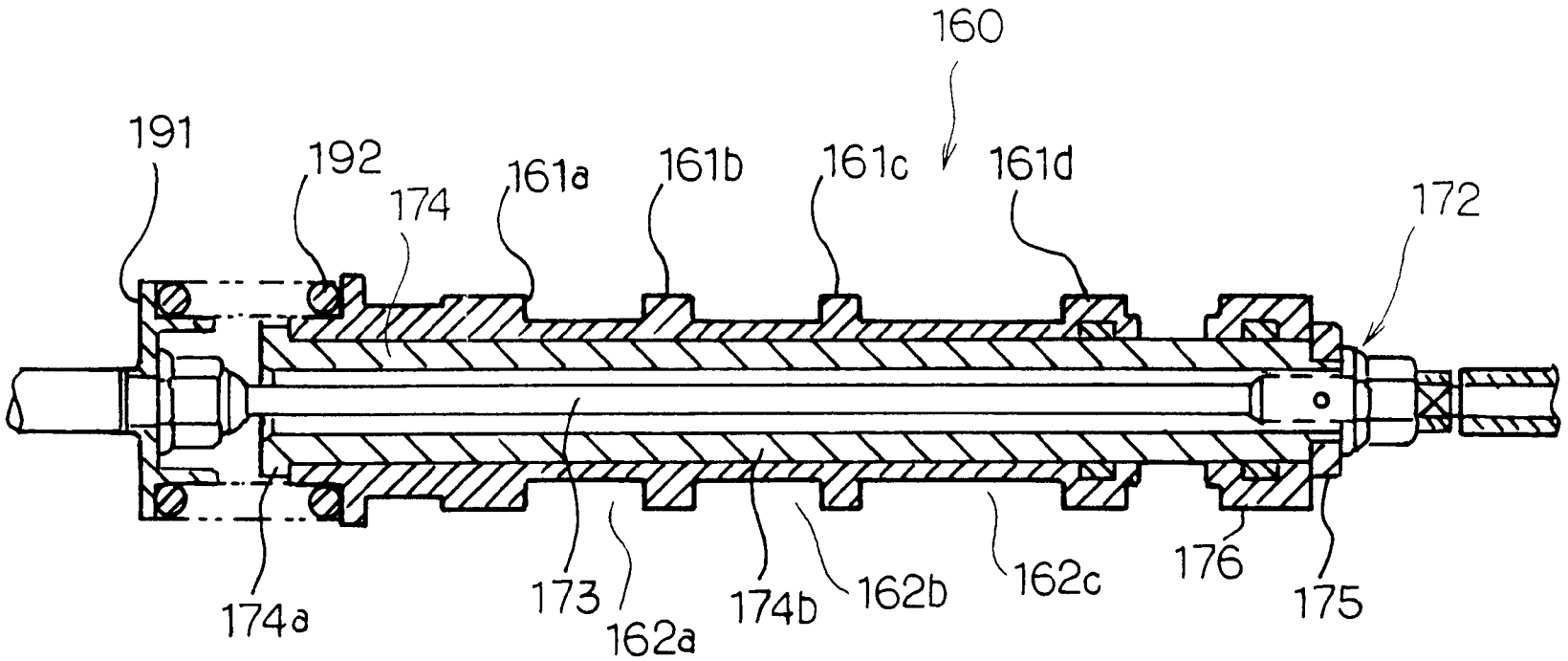
FIG. 7 is an enlarged fragmentary cross-sectional view of a valve spool and valve spool operating means constituting part of the preferred embodiment of the fluid control valve system according to the present invention.
Figure 8:
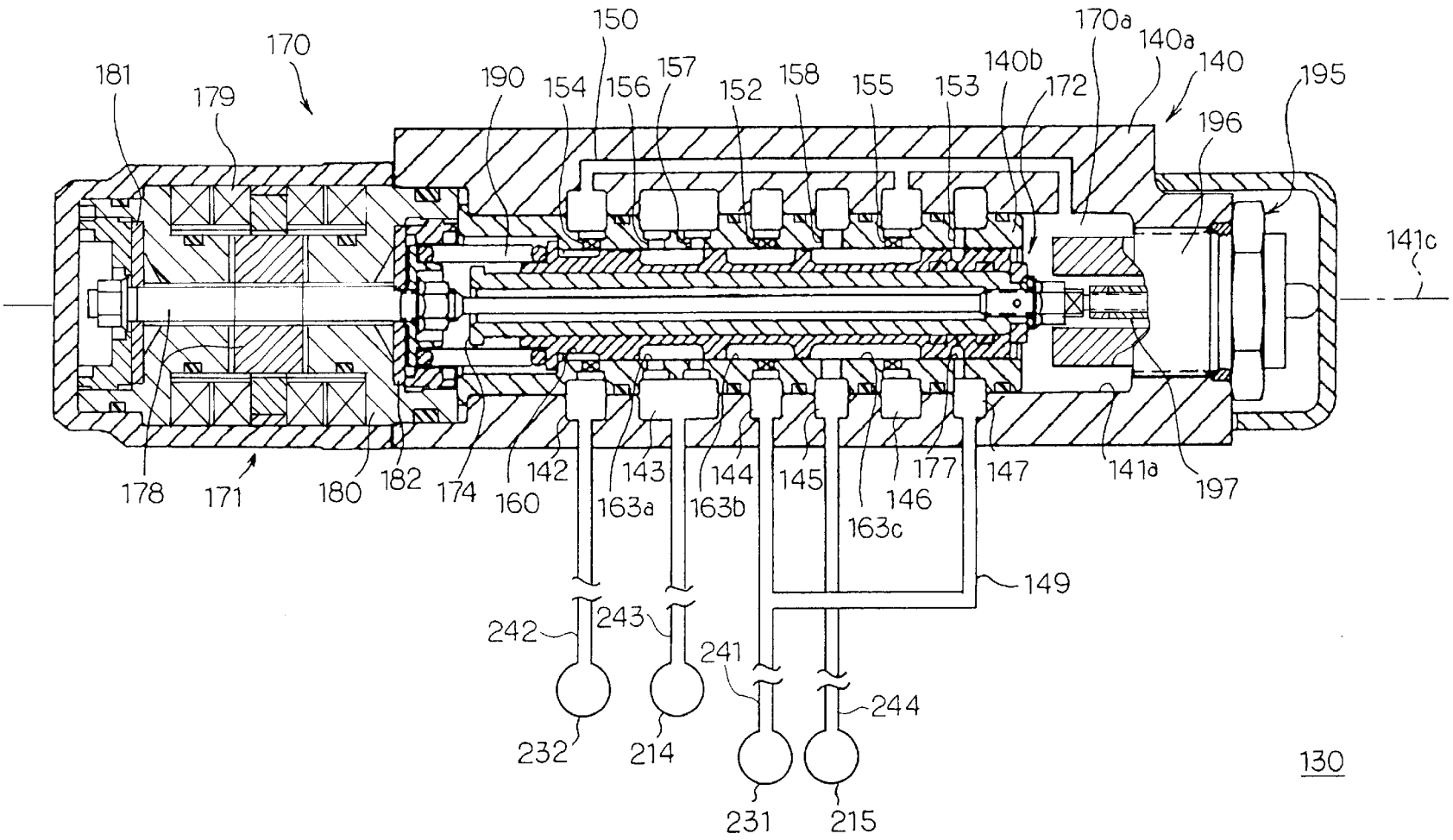
FIG. 8 is a view similar to FIG. 6 but showing that the spool valve is forced to move to assume its abnormal operation position.
Figure 9:
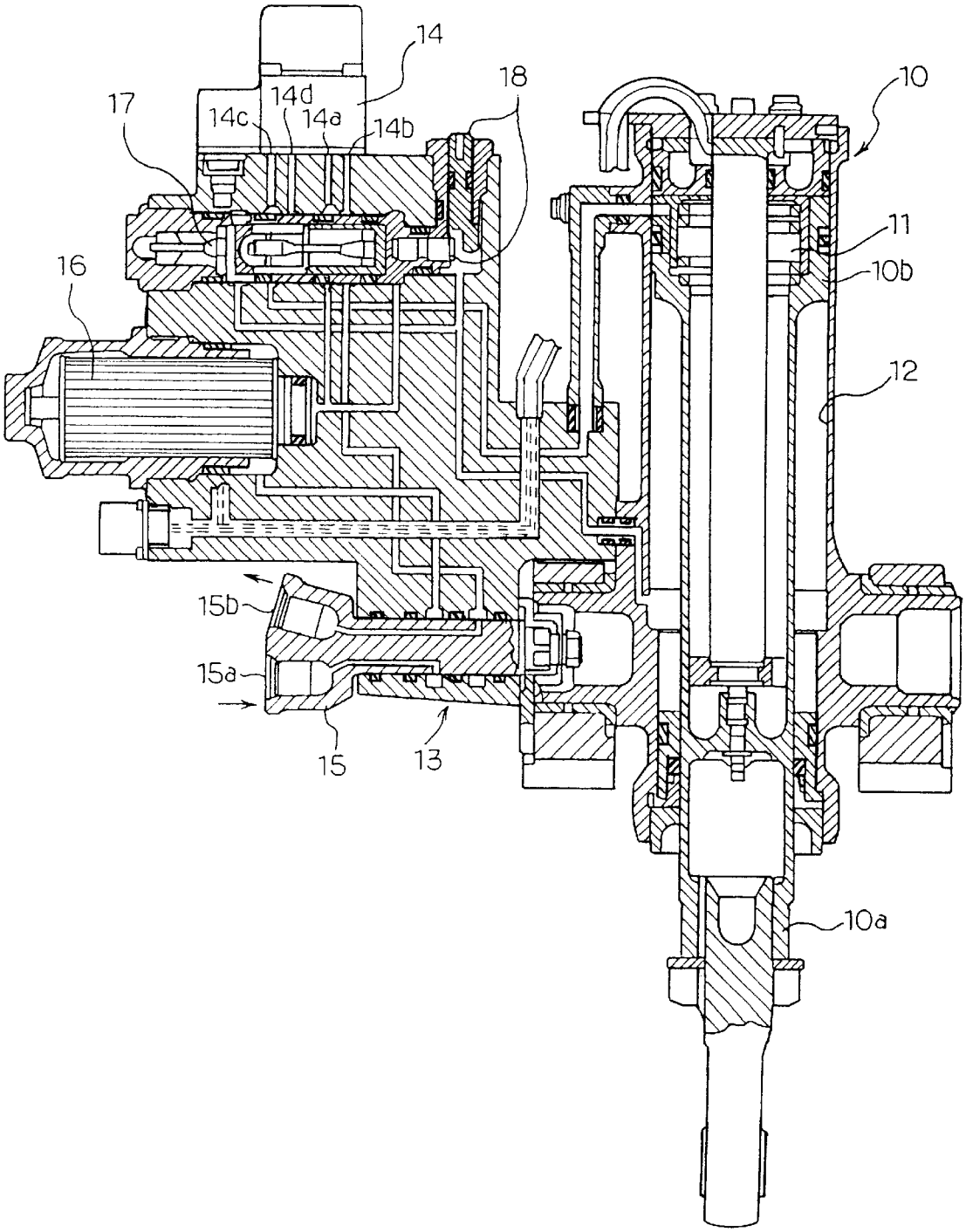
FIG. 9 (PRIOR ART)
FIG. 9 is a cross-sectional view of a conventional fluid control apparatus comprising a fluid control valve system for controlling an actuator.

The preferred embodiment of the control valve system according to the present invention will now be described with reference to FIGS. 6 to 8. The fluid control valve system 130 is shown in FIG. 6 as comprising a valve housing 140, a valve spool 160, valve spool operating means 170, and resiliently urging means 190.

The valve housing 140 comprises an outer housing portion 140*a* formed with a hole 141*a*, and an inner housing portion 140*b* hermetically sealedly received in the hole 141*a* of the outer housing portion 140*a*. The inner housing portion 140*b* is also formed with a hole 141*b* having a center axis 141*c*.

The outer and inner housing portions 140*a* and 140*b* form together first to sixth complementary fluid chambers 142 to 147. The first and fifth complementary fluid chambers 142 and 146 are connected with each other through a return fluid passageway 150 and held in communication with the return port 232 of the swivel joint 230 shown in FIG. 1. The second and fourth complementary fluid chamber 143 and 145 are respectively held in communication with the first and second actuator ports 214 and 215 of the hydraulic actuator 210 shown in FIG. 1. The third and sixth complementary fluid chambers 144 and 147 are connected with each other through a pressure fluid passageway 149 and held in communication with the pressure port 231 of the swivel joint 230 shown in FIG. 1.

The valve housing 140 comprises first and second pressure ports 152 and 153 formed in the inner housing portion 140*b* to have the third and sixth complementary fluid chambers 144 and 147 respectively open to the hole 141*b* of the inner housing portion 140*b* of the valve housing 140 and having hydraulic fluid supplied therethrough, and first and second return ports 154 and 155 formed in the inner housing portion 140*b* to have the first and fifth complementary fluid chambers 142 and 146 respectively open to the hole 141*b* of the inner housing portion 140*b* of the valve housing 140 and having the hydraulic fluid discharged therethrough. The valve housing 140 further comprises first and second work ports 156 and 157 and a third work port 158 all formed in the inner housing portion 140*b* to have the second and fourth complementary fluid chambers 143 and 145 respectively open to the hole 141*b* of the inner housing portion 140*b* of the valve housing 140 and having hydraulic fluid supplied and discharged therethrough.

The valve spool 160 is axially movably received in the hole 141*b* of the inner housing portion 140*b* of the valve housing 140 and formed with an axial through bore axially extending and open at its both axial ends. As best shown in FIG. 7, the valve spool 160 has an outer wall portion formed with first to fourth land portions 161*a* to 161*d* axially spaced apart from each other to form a first groove 162*a* between the first and second land portions 161*a* and 161*b*, a second groove 162*b* between the second and third land portions 161*b* and 161*c*, and a third groove 162*c* between the third and fourth land portions 161*c* and 161*d*. The first, second and third grooves 162*a*, 162*b* and 162*c* are axially spaced apart from each other and open at their outer surfaces thereof to define in combination with the peripheral surface of the inner wall portion of the inner housing portion 140*b* of the valve housing 140 first to third groove chambers 163*a* to 163*c* (see FIG. 6).

The valve spool 160 is movable with respect to the inner housing portion 140*b* of the valve housing 140 to assume three different normal operation positions consisting of a first normal operation position where the first, second and third groove chambers 163*a* to 163*c* are respectively held in communication with the first to third work ports 156 to 158, a second normal operation position where the first, second and third groove chambers 163*a* to 163*c* are respectively held in communication with the first work port 156, the second work port 157 and the first pressure port 152, and the third work port 158 and the second return port 155, and a third normal operation position where the first, second and third groove chambers 163*a* to 163*c* are respectively held in communication with the first return port 154 and the first work port 156, the second work port 157, and the first pressure port 152 and the third work port 158.

The valve spool operating means 170 comprises a force motor 171, a piston rod 172 driven to be axially reciprocated by the force motor 171 and having an axially intermediate portion 173 axially extending in the hole 141*b* of the inner housing portion 140*b* of the valve housing 140, a stop flange 174 firmly connected to the axially intermediate portion 173 and facing the force motor 171, and a fixed piston 175 firmly connected to the axial end of the axially intermediate portion 173 remotest from the force motor 171. The piston rod 172 is received in the hole 141*b* of the inner housing portion 140*b* of the valve housing 140 and forming a valve receiving chamber 170*a*.

The stop flange 174 comprises a radially extending flange portion 174*a*, and an axial portion 174*b* integrally formed with the radially extending flange portion 174*a* and received on the axially intermediate portion 173. The axial portion 174*b* of the stop flange 174 is firmly secured to the end of the axially intermediate portion 173 of the piston rod 172 adjacent to the fixed piston 175 of the valve spool operating means 170. The piston rod 172 further comprises a sleeve piston 176 slidably received on the axial portion 174*b* of the stop flange 174 in the vicinity of the fixed piston 175 in the hole 141*b* of the inner housing portion 140*b* of the valve housing 140.

The piston rod 172 have the valve spool 160 slidably received on the axial portion 174*b* of the stop flange 174 between the sleeve piston 176 and the radially extending flange portion 174*a* of the stop flange 174 to form a pressure sensing chamber 177 between the valve spool 160 and the sleeve piston 176 in the hole 141*b* of the inner housing portion 140*b* of the valve housing 140. The pressure sensing chamber 177 is held in communication with the second pressure port 153 of the inner housing portion 140*b* of the valve housing 140.

The force motor 171 comprises a core member 178 axially extending and securely connected to the piston rod 172, and an electromagnetic coil member 179 received in the valve housing 140 and operated by the control circuit, not shown in the drawings, to axially move the core member 178 together with the piston rod 172.

The valve spool operating means 170 further comprises a sleeve member 180 received in the valve housing 140 in coaxial relationship with the core member 178 of the force motor 171 and having an outer peripheral portion formed with a helical groove in which the electromagnetic coil member 179 is received, and a pair of plate springs 181 and 182 located at the respective axial ends of the sleeve member 180 and securely coupled with the core member 178 of the force motor 171 to resiliently urge the valve spool 160.

The resiliently urging means 190 is adapted to resiliently urge the valve spool 160 toward the fixed piston 175 of the valve spool operating means 170 along the center axis 141*c* of the inner housing portion 140*b* of the valve housing 140. The resiliently urging means 190 comprises a supporting flange 191 securely mounted on the axially intermediate portion 173 of the piston rod 172 between the force motor 171 and the stop flange 174, and a compression coil spring 192 securely connected to the supporting flange 191 between the supporting flange 191 and the valve spool 160 to resiliently urge the valve spool 160 toward the fixed piston 175. The compression coil spring 192 may be in coaxial relationship with the hole 141*b* of the inner housing portion 140*b* of the valve housing 140.

The control valve system further comprises displacement detection means 195 for detecting the axial displacement of the piston rod 172 to control the operation of the force motor 171. The displacement detection means 195 comprises a detection core member 196 axially extending and securely connected to the piston rod 172 and received in the outer housing portion 140*a* of the valve housing 140, a detection coil member 197 received in the outer housing portion 140*a* of the valve housing 140 to have the detection core member 196 electrically excited to produce an electric signal, and a control circuit, not shown in the drawings, for receiving the electric signal produced by the detection coil member 197 to control the operation of the force motor 171.

Referring back to FIG. 1, the structure of the fluid control apparatus 200 will now be described in detail.

The actuator 210 comprises a cylinder body 211 forming a cylinder chamber 212, a piston 213 axially received in the cylinder chamber 212 of the cylinder body 211 to have the cylinder chamber 212 divided into first and second chamber portions 212*a* and 212*b* respectively opened at first and second actuator ports 214 and 215, and a piston rod 216 having one end securely connected to the piston 213 and the other end securely connected to an exterior mechanical part such as a flapper for use in an aircraft.

The piston 213 and the piston rod 216 of the actuator 210 are axially moved when the hydraulic fluid is introduced into one of the first and second chamber portions 212*a* and 212*b* of the cylinder body 211 through one of the first and second actuator ports 214 and 215 and discharged from the other of the first and second chamber portions 212*a* and 212*b* of the cylinder body 211 through the other of the first and second actuator ports 214 and 215.

The supply port 231 and the return port 232 of the swivel joint 230 are held in communication with a fluid reservoir, not shown in the drawings, having the hydraulic fluid reserved therein. The hydraulic fluid in the fluid reservoir is adapted to be pumped out by way of a fluid pump, not shown in the drawings, which serves to produce a fluid pressure to the hydraulic fluid to be supplied to and discharged out of the actuator 210 through the fluid control valve system 130.

The housing 240 of the fluid control apparatus 200 is formed with a plurality of fluid passageways comprising a pressure fluid passageway 241, a return fluid passageway 242, and first and second working fluid passageways 243 and 244 all formed in the housing 240.

The supply port 231 of the swivel joint 230 is held in communication with the first and second pressure ports 152 and 153 (best shown in FIG. 6) of the fluid control valve system 130 through the pressure fluid passageway 241 having a filter 245 to filtrate the hydraulic fluid passing therethrough. The pressure fluid passageway 241 is bifurcated to have a pressure fluid passageway 149 held in communication with the first and second pressure ports 152 and 153.

The return port 232 of the swivel joint 230 is held in communication with the first and second return ports 154 and 155, shown in FIG. 6, of the fluid control valve system 130 through the return fluid passageway 242.

The first and second work ports 156 and 157, and the third work port 158 of the fluid control valve system 130 are held in communication with the first and second actuator ports 214 and 215 of the actuator 210 through the first and second working fluid passageways 243 and 244, respectively.

Operatively connected to the first and second working fluid passageways 243 and 244 and the return fluid passageway 242 are a manual relief valve 250 which can manually be operated to relieve the hydraulic fluid in the first and second working fluid passageways 243 and 244 to the return fluid passageway 242 when the fluid control valve system 130 becomes out of order.

In the housing 240 between the first working fluid passageway 243 and the return fluid passageway 242 is formed a first bypass fluid passageway 251 having a check valve 252 which functions to allow the hydraulic fluid to flow therethrough in a direction shown by an arrow in FIG. 1 in order to prevent the pressure of the hydraulic fluid in the first chamber portions 212*a* of the actuator 210 from decreasing to the level out of the predetermined normal range.

Also in the housing 240 between the first working fluid passageway 243 and the return fluid passageway 242 is formed a second bypass fluid passageway 253 having a thermal relief valve 254 which functions to allow the hydraulic fluid to flow therethrough in a direction shown by an arrow in FIG. 1 in order to prevent the pressure of the hydraulic fluid in the first chamber portion 212*a* of the actuator 210 from increasing to the predetermined pressure level as a result of the heat inflation of the hydraulic fluid in the first chamber portion 212*a* of the actuator 210 when the movement of the piston 213 and the piston rod 216 of the actuator 210 are blocked by some substances in the first and second working fluid passageways 243 and 244.

There is provided in the housing 240 an angular position detector 255 which is designed to detect the angular position of the actuator 210 with respect to the aircraft body to produce a signal to a signal receiving device 256. The signal receiving device 256 is also adapted to received a signal produced by the displacement detection means 195 in addition to the signal produced by the angular position detector 255 previously mentioned so that the signals of the displacement detection means 195 and the angular position detector 255 received by the signal receiving device can be processed in the control circuit to produce a control signal to the force motor 171 for controlling the axial movement of the force motor 171.

The operation of the control valve system 130 previously mentioned will be described hereinafter with reference to FIGS. 6 to 8.

The valve spool 160 is urged by the hydraulic pressure of the hydraulic fluid in the pressure sensing chamber 177 and the resiliently urging means 190 to assume different operation positions consisting of first to third normal operation positions and an abnormal operation position.

When the hydraulic fluid is supplied to and introduced into the pressure sensing chamber 177 through the second pressure port 153 to give the hydraulic pressure to the hydraulic fluid of the pressure sensing chamber 177, the hydraulic pressure of the hydraulic fluid in the pressure sensing chamber 177 becomes larger than the axial force of the resiliently urging means 190. Then, the valve spool 160 is urged toward the radially extending flange portion 174*a* of the stop flange 174 to have its one axial end brought into contact with the radially extending flange portion 174*a* while the sleeve piston 176 is urged toward the fixed piston 175 of the valve spool operating means 170 to have its one axial end brought into contact with the fixed piston 175 to assume a first normal operation position as shown in FIG. 6.

At this time, the first pressure port 152 is closed by the third land portion 161*c* of the valve spool 160, the first and second return ports 154 and 155 are respectively closed by the first and fourth land portions 161*a* and 161*d* of the valve spool 160, and the first and second groove chambers 163*a* and 163*b* and the third groove chamber 163*c* are respectively held in fluid communication with the first and second work ports 156 and 157 and the third work port 158 of the inner housing portion 140*b* of the valve housing 140. Therefore, the hydraulic fluid is not introduced into or discharged out of the actuator 210.

The valve spool 160 is then reciprocated to assume the second and third normal operation positions away from the first normal operation position previously mentioned by the force motor 171 with the one axial end of the valve spool 160 held in contact with the stop flange 174 of the valve spool operating means 170, in cooperation with the piston rod 172.

When the piston rod 172 is moved, for example, rightward in FIG. 6 by the force motor 171, the valve spool 160 assumes the second normal operation position where the first and second pressure ports 152 and 153 are respectively opened to the second groove chamber 163*b* and the pressure sensing chamber 177 with the second groove chamber 163*b* being brought into fluid communication with the second work port 157 to supply the hydraulic fluid to the first actuator port 214 of the actuator 210. At the same time, the first return port 154 is closed by the first land portion 161*a* of the valve spool 160 with the second return port 155 being opened to the third groove chamber 163*c* of the valve spool 160 to have the hydraulic fluid from the second actuator port 215 of the actuator 210 returned to the third groove chamber 163*c*. It is therefore to be noted that the hydraulic fluid is introduced into the first chamber portion 212*a* of the actuator 210 through the first actuator port 214 of the actuator 210 while the hydraulic fluid in the second chamber portion 212*b* of the actuator 210 is returned to the third groove chamber 163*c*.

When the piston rod 172 is in turn moved, for example, leftward in FIG. 6 by the force motor 171, the valve spool 160 assumes the third normal operation position where the first and second pressure ports 152 and 153 are respectively opened to the third groove chamber 163*c* and the pressure sensing chamber 177 with the third groove chamber 163*c* being brought into fluid communication with the third work port 158 to supply the hydraulic fluid to the second actuator port 215 of the actuator 210. At the same time, the second return port 155 is closed by the fourth land portion 161*d* of the valve spool 160 with the first return port 154 being opened to the first groove chamber 163*a* of the valve spool 160 to have the hydraulic fluid from the first actuator port 214 of the actuator 210 returned to the first groove chamber 163*a*. It is therefore to be understood that the hydraulic fluid is introduced into the second chamber portion 212*b* of the actuator 210 through the second actuator port 215 of the actuator 210 while the hydraulic fluid in the first chamber portion 212*a* of the actuator 210 is returned to the first groove chamber 163*a*.

In the event that the hydraulic fluid is not supplied to the pressure sensing chamber 177 for some reason, the hydraulic pressure of the hydraulic fluid in the pressure sensing chamber 177 is reduced and becomes lower than the predetermined pressure. Therefore, the resiliently urging means 190 starts to urge and axially move the valve spool 160 toward the fixed piston 175 to have the valve spool 160 brought into contact with the sleeve piston 176 of the valve spool operating means 170 and assume an abnormal operation position as shown in FIG. 8.

At this time, the first and second pressure ports 152 and 153 are not held in communication with neither of the first to third work ports 156 to 158. The hydraulic fluid is thus not introduced into the actuator 210.

In the above embodiment shown in FIGS. 2 to 5, there has been described hereinbefore about the fact that the valve spool operating means 70 further comprises a sleeve piston 76 slidably received on the axially intermediate portion 73 between valve spool 60 and the fixed piston 75 in the hole 41 of the valve housing 40 to make it possible for the valve spool 60 to be brought into contact with the fixed piston 75 of the valve spool operating means 70 by way of the sleeve piston 76, however, the valve spool 60 may be brought into direct contact with the fixed piston 75 of the valve spool operating means 70 without providing the sleeve piston 76 according to the present invention. For the similar reason, the valve spool 160 may be brought into direct contact with the fixed piston 175 of the valve spool operating means 170 without providing the sleeve piston 176 according to the present invention although the sleeve piston 176 is slidably received on the axial portion 174*b* of the stop flange 174 in the vicinity of the fixed piston 175 in the hole 141*b* of the inner housing portion 140*b* of the valve housing 140 to make it possible for the valve spool 160 to be brought into contact with the fixed piston 175 of the by way of the sleeve piston 176 in the above embodiment shown in FIGS. 6 to 8.

While the present invention has thus been shown and described with reference to the specific embodiment, however, it should be noted that the invention is not limited to the details of the illustrated structures but changes and modifications may be made without departing from the scope of the appended claims.

What is claimed is:

1. A fluid control valve system for controlling the flow of hydraulic fluid supplied to and discharged out of an actuator having first and second actuator ports, comprising:

a valve housing formed with a hole having a center axis to have an inner wall portion with a peripheral surface, said valve housing having first and second pressure ports having hydraulic fluid supplied therethrough, first and second return ports having said hydraulic fluid discharged therethrough, and first and second work ports respectively being held in communication with said first and second actuator ports of said actuator and having hydraulic fluid supplied and discharged therethrough;

a valve spool axially movably received in said hole of said valve housing and formed with an axial through bore axially extending and open at its axial ends, said valve spool having an outer wall portion formed with first to third land portions axially spaced apart from each other to form a first groove between said first and second land portions and a second groove between said second and third land portions, said first and second grooves being axially spaced apart from each other and open at their outer surfaces thereof to define in combination with said peripheral surface of said inner wall portion of said valve housing first and second groove chambers respectively held in fluid communication with said first and second work ports of said valve housing and being able to be brought selectively into fluid communication with said first pressure port and said first return port, and said first pressure port and said second return port, of said valve housing;

valve spool operating means including a force motor, a piston rod driven to be axially reciprocated by said force motor and having an axially intermediate portion axially extending in said hole of said valve housing, a stop flange firmly connected to said axially intermediate portion and facing said force motor, and a fixed piston firmly connected to the axial end of said axially intermediate portion remotest from said force motor, said piston rod having said valve spool slidably received on said axially intermediate portion between said stop flange and said fixed piston to form a pressure sensing chamber between said valve spool and said fixed piston in said hole of said valve housing, said pressure sensing chamber being held in communication with said second pressure port of said valve housing; and resiliently urging means for resiliently urging said valve spool toward said fixed piston of said valve spool operating means along said center axis of said valve housing, said valve spool being urged by the hydraulic pressure of the hydraulic fluid in said pressure sensing chamber and said resiliently urging means to assume operation positions consisting of:

normal operation positions where the hydraulic fluid is supplied to said pressure sensing chamber to give the hydraulic pressure to the hydraulic fluid of said pressure sensing chamber, said hydraulic pressure in said pressure sensing chamber having said valve spool urged toward said stop flange against said resiliently urging means to have said valve spool brought into contact with said stop flange, said valve spool being reciprocated by said force motor with said piston rod to have said first pressure port and said first return port, and said first pressure port and said second return port selectively held in communication with said first and second actuator ports of said actuator respectively through said first and second work ports of said valve housing; and an abnormal operation position where the hydraulic pressure in said pressure sensing chamber is reduced until said resiliently urging means starts to urge and axially move said valve spool toward said fixed piston, said second pressure port being held out of communication with said first and second actuator ports of said actuator.

2. A fluid control valve system according to claim 1, in which said normal operation positions consisting of:

a first normal operation position where said first pressure port is closed by said second land portion of said valve spool, said second pressure port is open to said pressure sensing chamber, said first and second return ports are respectively closed by said first and third land portions of said valve spool, said first and second groove chambers are held in fluid communication with said first and second work ports of said valve housing when said force motor is not driven in any axial directions of said piston rod;

a second normal operation position where said first and second pressure ports are respectively opened to said first groove chamber and said pressure sensing chamber with said first groove chamber being brought into fluid communication with said first work port to supply the hydraulic fluid to said first actuator port of said actuator, said first return port is closed by said first land portion of said valve spool with said second return port being opened to said second groove chamber of said valve spool to have the hydraulic fluid from said second actuator port of said actuator returned when said force motor is driven in one of the axial directions of said piston rod; and a third normal operation position where said first and second pressure ports are respectively opened to said second groove chamber and said pressure sensing chamber with said second groove chamber being brought into fluid communication with said second work port to supply the hydraulic fluid to said second actuator port of said actuator, said second return port is closed by said third land portion of said valve spool with said first return port being opened to said first groove chamber of said valve spool to have said hydraulic fluid from said first actuator port of said actuator returned when said force motor is driven in the other of the axial directions of said piston rod.

3. A fluid control valve system according to claim l, in which said resiliently urging means further comprises a supporting flange securely mounted on said axially intermediate portion of said piston rod between said force motor and said stop flange, and a compression coil spring securely connected to said supporting flange between said supporting flange and said valve spool to resiliently urge said valve spool toward said fixed piston.

4. A fluid control valve system according to claim 3, in which said compression coil spring is in coaxial relationship with said hole of said valve housing.

5. A fluid control valve system according to claim 1, in which said valve spool operating means further comprises a sleeve piston slidably received on said axially intermediate portion of said piston rod between said valve spool and said fixed piston to have said pressure sensing chamber formed between said valve spool and said sleeve piston in said hole of said valve housing so that the valve spool can be brought into contact with said fixed piston of said valve spool operating means by way of said sleeve piston.

6. A fluid control valve system for controlling the flow of hydraulic fluid supplied to and discharged out of an actuator having first and second actuator ports, comprising:

a valve housing formed with a hole having a center axis to have an inner wall portion with a peripheral surface, said valve housing having first and second pressure ports having hydraulic fluid supplied therethrough, first and second return ports having said hydraulic fluid discharged therethrough, and first and second work ports respectively being held in communication with said first and second actuator ports of said actuator and having hydraulic fluid supplied and discharged therethrough, a pressure fluid passageway having said first and second pressure ports held in communication with each other, and a return fluid passageway having said first and second return ports held in communication with each other;

a valve spool axially movably received in said hole of said valve housing and formed with an axial through bore axially extending and open at its axial ends, said valve spool having an outer wall portion formed with first to fourth land portions axially spaced apart from each other to form a first groove between said first and second land portions, a second groove between said second and third land portions and a third groove between said third and fourth land portions, said first, second and third grooves being axially spaced apart from each other and open at their outer surfaces thereof to define in combination with said peripheral surface of said inner wall portion of said valve housing first to third groove chambers, said first groove chamber being held in fluid communication with said first work port and able to be brought selectively into fluid communication with said first return port of said valve housing, said second groove chamber being held in fluid communication with said first work port and able to be brought selectively into fluid communication with said first pressure port of said valve housing, while said third groove chamber being held in fluid communication with said second work port and able to be brought selectively into fluid communication with said first pressure port and said second return port of said valve housing;

valve spool operating means including a force motor, a piston rod driven to be axially reciprocated by said force motor and having an axially intermediate portion axially extending in said hole of said valve housing, a stop flange firmly connected to said axially intermediate portion and facing said force motor, and a fixed piston firmly connected to the axial end of said axially intermediate portion remotest from said force motor, said piston rod having said valve spool slidably received on said axially intermediate portion between said fixed piston and said stop flange to form a pressure sensing chamber between said valve spool and said fixed piston in said hole of said valve housing, said pressure sensing chamber being held in communication with said second pressure port of said valve housing; and resiliently urging means for resiliently urging said valve spool toward said fixed piston of said valve spool operating means along said center axis of said valve housing, said valve spool being urged by the hydraulic pressure of the hydraulic fluid in the pressure sensing chamber and said resiliently urging means to assume operation positions consisting of:

normal operation positions where the hydraulic fluid is supplied to said pressure sensing chamber to give the hydraulic pressure to the hydraulic fluid in said pressure sensing chamber, said hydraulic pressure in said pressure sensing chamber having said valve spool urged toward said stop flange against said resiliently urging means to have said valve spool brought into contact with said stop flange, said valve spool being reciprocated by said force motor with said piston rod to have said first pressure port and said first return port, and said first pressure port and said second return port selectively held in communication with said first and second actuator ports of said actuator respectively through said first and second work ports of said valve housing; and an abnormal operation position where the hydraulic pressure in said pressure sensing chamber is reduced until said resiliently urging means starts to urge and axially move said valve spool toward said fixed piston, said first pressure port being held out of communication with said first and second actuator ports of said actuator.

7. A fluid control valve system according to claim 6, in which said normal operation positions consisting of:

a first normal operation position where said first pressure port is closed by said third land portion of said valve spool, said second pressure port is open to said pressure sensing chamber, said first and second return ports are respectively closed by said first and fourth land portions of said valve spool, and said first and second groove chambers and said third groove chamber are respectively held in fluid communication with said first and second work ports of said valve housing when said force motor is not driven in any axial directions of said piston rod;

a second normal operation position where said first and second pressure ports are respectively opened to said second groove chamber and said pressure sensing chamber with said second groove chamber being brought into fluid communication with said first work port to supply the hydraulic fluid to said first actuator port of said actuator, said first return port is closed by said first land portion of said valve spool with said second return port being opened to said third groove chamber of said valve spool to have the hydraulic fluid from said second actuator port of said actuator returned when said force motor is driven in one of the axial directions of said piston rod; and a third normal operation position where said first and second pressure ports are respectively opened to said third groove chamber and said pressure sensing chamber with said third groove chamber being brought into fluid communication with said second work port to supply the hydraulic fluid to said second actuator port of said actuator, said second return port is closed by said fourth land portion of said valve spool with said first return port being opened to said first groove chamber of said valve spool to have said hydraulic fluid from said first actuator port of said actuator returned when said force motor is driven in the other of the axial directions of said piston rod.

8. A fluid control valve system according to claim 6, in which said resiliently urging means further comprises a supporting flange securely mounted on said axially intermediate portion of said piston rod between said force motor and said stop flange, and a compression coil spring securely connected to said supporting flange between said supporting flange and said valve spool to resiliently urge said valve spool toward said fixed piston.

9. A fluid control valve system according to claim 8, in which said compression coil spring is in coaxial relationship with said hole of said valve housing.

10. A fluid control valve system according to claim 6, in which said valve spool operating means further comprises a sleeve piston slidably received on said axially intermediate portion of said piston rod between said valve spool and said fixed piston to have said pressure sensing chamber formed between said valve spool and said sleeve piston in said hole of said valve housing so that the valve spool can be brought into contact with said fixed piston of said valve spool operating means by way of said sleeve piston.

* * * * *